US005799714A

United States Patent [19]

Teal et al.

[11] Patent Number: 5,799,714

[45] Date of Patent: Sep. 1, 1998

[54] SPRING-ACTUATED BASKET BOTTOM PANEL FORM

[75] Inventors: Tim Teal, Mount Vernon; Robert R. Rueckert, Blue Rock; Jack J. Hindel, Frazeysburg, all of Ohio

[73] Assignee: The Longaberger Company, Newark, Ohio

[21] Appl. No.: 431,090

[22] Filed: Apr. 28, 1995

[51] Int. Cl.[6] ..... B27J 1/00

[52] U.S. Cl. ..... 147/48

[58] Field of Search ..... 147/48; 29/463, 29/464

[56] References Cited

U.S. PATENT DOCUMENTS

| | | | |
|---|---|---|---|
| 285,053 | 9/1883 | Miller | 147/48 |
| 450,114 | 4/1891 | Snow | 147/48 |
| 467,986 | 2/1892 | Folger | 147/48 |
| 597,624 | 1/1898 | Titus | 147/48 |
| 1,116,820 | 11/1914 | Huke | 147/48 |
| 3,563,292 | 2/1971 | Gordon et al. | 147/48 |

*Primary Examiner*—John M. Husar

*Attorney, Agent, or Firm*—Porter, Wright, Morris & Arthur

[57] ABSTRACT

A spring-actuated basket form including a platform, a spacer housed within a cavity recessed below the platform surface, and a pair of reinforcement guides. The reinforcement guides form a space therebetween capable of removably receiving a reinforcement splint during basket assembly. The spacer's perimeter wall communicates with the inner wall of the cavity. A spring is coupled to the spacer to facilitate tensioned movement of the spacer within the cavity. The spring urges the spacer and its associated movable reinforcement guide toward the other guide to retain a reinforcement splint within the space. An adjustable alignment rim may be provided on the platform surface at a distance from the reinforcement guides.

25 Claims, 6 Drawing Sheets

SPRING-ACTUATED BASKET BOTTOM PANEL FORM

BACKGROUND AND SUMMARY OF THE INVENTION

This invention relates generally to an apparatus for facilitating the construction of hand-woven baskets, and more particularly to an apparatus including a spring-actuated guide, or form, for use in making basket bottom panels. The apparatus assists in accurately aligning the weaving splints that comprise the basket bottom panel, and in releasably retaining basket bottom reinforcement splints during construction of the bottom panel.

Hand-woven baskets, and particularly hand-woven rectangular baskets, are often made using a two-step process in which the basket bottom panel is formed separately from the side panels. The bottom panel is constructed in the first, or "forming" step, and the side panels are constructed, with the aid of a basket mold, in the second, or weaving step.

The bottom panel comprises a rectangular woven center with unwoven splint ends projecting outwardly from all sides of the center. The woven center will form the bottom of the basket and the unwoven splint ends will form the vertical structure of the basket side panels. The basket bottom panel may be formed by selecting weaving splints that are at least twice the desired height of the basket side panels plus the length or width of the basket, depending upon the intended orientation of the splint relative to the basket bottom.

Certain weaving splints, referred to as cross splints, are arranged in parallel relationship to one another on a work table or other flat surface. Each cross splint is transversely spaced from an adjacent splint, although the spacing may vary with the basket design. Fill splints may be inserted between the cross splints, if desired, to aid in the spacing of the cross splints and to provide a more solid basket bottom by reducing the size of the gaps that otherwise would be present between the cross splints in the bottom panel. The fill splints do not extend beyond the edges of the basket bottom and do not form any part of the vertical structure of the side panels of the basket.

Other weaving splints, referred to as up splints, are oriented perpendicularly to the cross splints. As with the cross splints, the up splints are generally arranged in spaced parallel relationship with one another, although the spacing may vary with the basket design. The up splints are woven through the cross splints in a desired pattern. An alternating over-and-under pattern commonly is used, although other weave patterns also may produce satisfactory results. The weaving continues until the woven center attains the shape and dimensions desired for the basket bottom. As described above, however, the weaving is limited to the center sections of the splints, leaving unwoven splint ends extending from each side of the woven center.

The bottom of a hand-woven basket may be reinforced to strengthen the basket, provide a base to which the woven splints may be secured, and give the basket a more finished appearance, although it is possible to construct a satisfactory basket without reinforcements. At least two laterally extending reinforcement splints, in spaced parallel relationship to one another, are customarily provided along both the inner and outer surfaces of the bottom panel, although a different number of reinforcements may be used depending on the design, size and intended purpose of the basket.

Inner reinforcements (i.e., the reinforcements that will be located on the interior of the finished basket) are placed on the upper surface of the work platform before the cross splints are arranged on the platform surface, in substantially parallel relationship to the desired placement of the cross splints. Outer reinforcements (i.e., the reinforcements that will be located on the exterior of the finished basket) are placed on the woven center of the panel, parallel to the cross splints, after the woven center of the bottom panel has been completed. The outer reinforcements are positioned in substantially overlaying relationship to any inner reinforcements. The position of the inner reinforcements, which are hidden from view by the woven center of the panel, may be determined by pressing on the panel to locate the areas with less "give," indicating the presence of an underlying inner reinforcement.

The weaving splints (and any reinforcements used) usually are secured together when the center of the bottom panel has been woven to its desired size to prevent disturbance of the arrangement of the splints during transfer of the bottom panel to a basket mold and positioning of the bottom panel on the mold. Preferably, this is accomplished using fasteners such as tacks, although other suitable methods of securing the bottom panel components also may be used.

The side panels of the basket are formed in the second step with the aid of a basket mold. The mold has a bottom and side walls that are sized and shaped to correspond to the desired size and shape of the basket interior. The mold may be supported on a weaving stand, or "horse," to facilitate rotation of the mold and the partially constructed basket during the weaving step. Advantageously, the horse can support the mold in a generally upright position and a generally horizontal position to allow the weaver to vary the position of the mold. An inner top band, which defines the top edge or rim of the basket, may be wrapped around the mold along the upper edges of the side walls and secured in this position by any suitable method.

The formed bottom panel is lifted from its work surface and transferred to the basket mold. The formed panel is positioned on the mold with the woven center aligned with the mold bottom and secured to the mold by a clamp. The ends of the weaving splints are bent around the mold to conform substantially to the sides of the mold. The side panels of the basket are then constructed by weaving strips through the splints, usually beginning in the area adjacent to the woven center of the bottom panel and working toward the free ends of the weaving splints, using the mold to guide the shape of the basket side panels. When the side panels have reached a desired height, i.e., the location of the inner band on the mold, the ends of the weaving splints are trimmed as close as possible to the upper edge of the inner band. An outer top band may be wrapped over the splint ends in substantially overlaying relationship to the inner top band. The splint ends are secured to the bands by fasteners or the like, and the completed basket is lifted from the mold.

Because bottom panel construction may affect both the strength of the basket and the framework for the basket side panels, defects in basket bottom panels are particularly likely to result in baskets of inferior quality. When such defects occur, the likelihood of successful repair depends, in part, on detection of the error soon after the bottom panel is made. If the error is not detected for some time after the bottom panel is completed, the bottom panel components are likely to be drier and less flexible than they were immediately after the panel was made, and are therefore more likely to break during repair. If the error is not detected until after the bottom panel is incorporated into a finished basket, repair will be even more difficult, if not impossible.

Consumer expectations with respect to basket quality are high, particularly in connection with premium and collectible baskets. Subtle irregularities and slight variations from basket to basket are acceptable, and indeed are desirable because they give hand-woven baskets their special character. However, a basket with excessive irregularities and variations may be cosmetically displeasing, and therefore unacceptable to consumers, even if it is structurally sound. In addition, excessive irregularities in bottom panels may result in decreased production inefficiency, for example, by requiring a weaver to spend more time fitting the bottom panel to a basket mold in preparation for construction of the basket side panels.

To achieve more uniform, higher quality bottom panels, formers may use a guide apparatus to assist in aligning the weaving splints and positioning of the inner reinforcements. However, it is difficult to locate the reinforcement guides on known guide apparatus such that all of the inner reinforcement splints are tightly received in their respective spaces on the apparatus, yet able to be removed easily from these spaces when the basket bottom panel has been completed, particularly in view of possible variations in the size of the reinforcement splints. The tendency of the inner reinforcement splints to slip out of their desired positions on known guides is exacerbated by the use of a smooth, puncture resistant plate on the guide apparatus under the desired position of the reinforcement, which provides a suitable surface for tacking the bottom panel components together. As a result, the former may have difficulty in placing the outer reinforcements both in their desired location and in substantially overlaying relationship to the inner reinforcements, or in securely fastening the weaving splints to the inner reinforcements. The desire to avoid slippage of the inner reinforcements may cause the former to slow the rate at which the bottom panel is assembled, resulting in decreased production.

If the former knows or believes that the inner reinforcements have slipped out of position before the bottom panel components have been secured together, he or she may attempt to reposition the reinforcements. Such effort is likely to disrupt the formed bottom panel, requiring the former to make time-consuming adjustments to the bottom panel after repositioning the reinforcements. If, however, the former is unable to detect that the inner reinforcements have slipped out of place before the basket bottom components have been secured together, the resulting bottom panel may have insufficient structural integrity to accomplish its desired purpose. Even if the misalignment of the reinforcements is not serious enough to affect the structural integrity of the basket, the appearance of the basket may be cosmetically displeasing, and therefore unacceptable. Thus, misalignment of inner reinforcements may result in costly repairs or the waste of baskets or basket components that required considerable time to make.

Inconsistencies in the position of reinforcements also may contribute to inefficiency in the second stage of basket production, by requiring that a weaver adjust the position of the formed basket bottom on a basket bottom. Faster production may be possible if the splints were positioned more uniformly.

Known guides are unique to a basket with particular bottom and side panel dimensions. A guide suitable for use in forming a bottom panel for one basket cannot easily be used to form the bottom panel for another basket, even when the baskets have the same bottom dimensions, because the position of the splint alignment rims on the guide corresponds to the desired height of the basket side panels. Although it also may be possible for a skilled former to produce baskets with different side panel dimensions on a single guide, this process would be slow and would probably adversely affect basket quality because the former would be required to rely to a greater extent on his or her eyesight and judgment in positioning the splints on the guide and aligning them relative to one another. Accordingly, different guides generally are provided for each unique combination of bottom and side panel dimensions. Construction and storage of these guides is expensive and time-consuming.

In light of the disadvantages of the prior art, an apparatus is needed that can assist a former in aligning weaving splints and positioning inner reinforcement splints during bottom panel construction, that will allow the former to produce bottom panels more quickly, and that will allow the use of a single guide apparatus to produce baskets having different side panel heights.

Accordingly, it is an object of the present invention to provide an apparatus and method for assisting in the construction of basket bottom panels that is faster and more efficient than construction of bottom panels using known guides.

A second object of the present invention is to provide an apparatus and method that consistently secures the positioning and alignment of a reinforcement splint in a desired relationship to the bottom panel during bottom panel assembly.

A third object of the present invention is to provide an apparatus with guides that permit convenient removability of a reinforcement splint and its associated basket panel from the apparatus upon completion of the bottom panel assembly.

A fourth object of the present invention is to provide an apparatus that reduces the reliance on human eyesight, judgment and dexterity in the alignment of basket making components.

Another object of the present invention is to provide an apparatus that assists in positioning of reinforcement splints which can easily be installed in existing bottom panel guides.

Yet another object of the present invention is to provide a apparatus that is adapted for use in forming bottom panels for baskets that have different side panel heights.

The foregoing objectives are achieved in an apparatus for facilitating the construction of hand-woven basket bottom panels. The invention includes a platform having a cavity located therein. A spacer having a perimeter wall is housed within the cavity whereby the perimeter wall of the spacer communicates with the inner wall of the cavity. A spring is attached to the spacer which facilitates tensioned movement of the spacer within the platform cavity. First and second longitudinally extending and transversely separated reinforcement guides communicate with the platform. A space is formed between the first and second reinforcement guides enabling a reinforcement splint to be received therein. The first guide is attached to the spacer and is capable of retraction relative to the second guide. Each reinforcement guide exerts pressure on the reinforcement splint thereby holding the splint in position during basket assembly. The apparatus also includes locators that extend transversely upward from the platform surface. The locators assist in aligning the corners of a basket's bottom panel. Alignment rims, positioned a predetermined distance from the first reinforcement guide, assist in the accurate placement of a weaving splint during construction.

These and further objects of the invention will become apparent from the following detailed description.

DETAILED DESCRIPTION OF THE PREFERRED EMBODIMENT(S)

Figure 1:
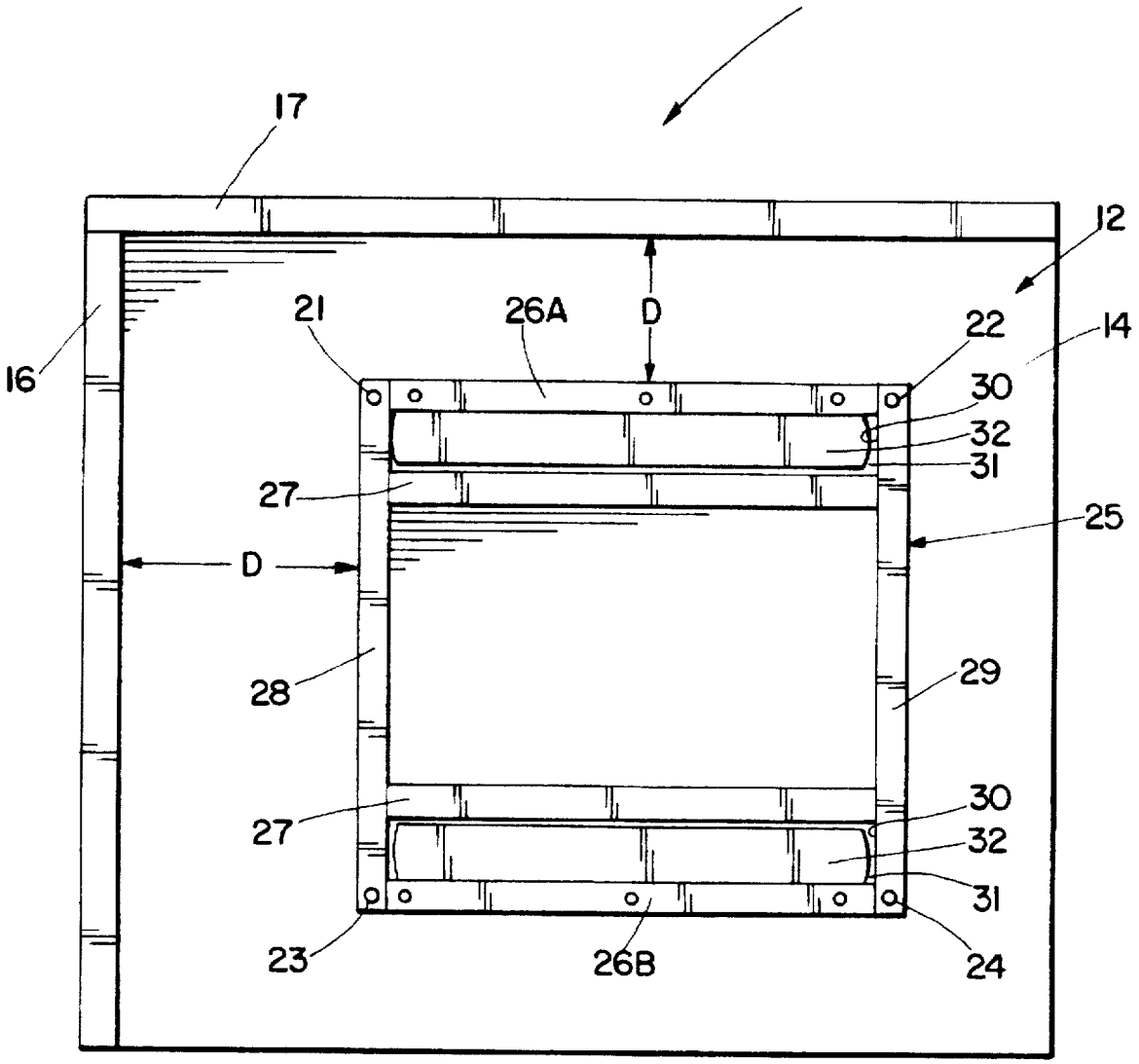
Fig. 1 (PRIOR ART)
FIG. 1 is a top plan view of a known guide for forming basket bottom panels.

Referring now to the drawings, FIG. 1 shows a known apparatus 10 for forming basket bottom panels. The apparatus 10 includes a platform 12 having a substantially horizontal upper planar surface 14. Alignment rims 16 and 17 extend transversely from the platform's upper surface 14, usually at the periphery of the platform 12. Grid-like markings, not shown in the drawings, may be provided on the upper surface 14 to further assist in alignment of the weaving splints.

Locators 21, 22, 23 and 24 extend transversely from the platform surface 14 in a rectangular pattern. The locators 21, 22, 23 and 24 define the corners of the woven center of the basket bottom panel. The distance D between the top 21, 22 and left 21, 23 locator pairs and the corresponding alignment rim 16, 17 defines the height of the basket's side wall panels.

The apparatus 10 includes a guide frame 25 to assist in positioning of the inner reinforcements. The frame 25 includes opposing laterally extending fixed outer edge guides 26A, 26B and border members 28, 29. The inner borders of the frame 25 are within the rectangle defined by the locators 21, 22, 23, 24. A fixed laterally extending inner edge guide 27 is transversely spaced from an outer edge guide 26A, 26B. Each pair of inner and outer edge guides defines a space 30 therebetween capable of receiving a reinforcement splint having a width within a predetermined range. The number of edge guide pairs depends on the number of reinforcement splints desired, which may vary with the design and size of the basket bottom panel. The border members 28, 29 extend perpendicularly between the left and right ends, respectively, of the edge guides 26A, 26B and 27. The border members 28, 29 define the maximum length of a reinforcement splint and limit the lateral movement of the reinforcement splint within the frame 25. The edge guides 26A, 26B, 27 and border members 28, 29 may be integral to the platform 12, or may comprise one or more discrete components secured to the platform 12. A puncture-resistant plate 31 may be provided between the outer 26A, 26B and inner 27 edge guides beneath the space 30 to provide a suitable base for tacking basket components to one another, if desired, without damage to the guide 10.

Figure 2:
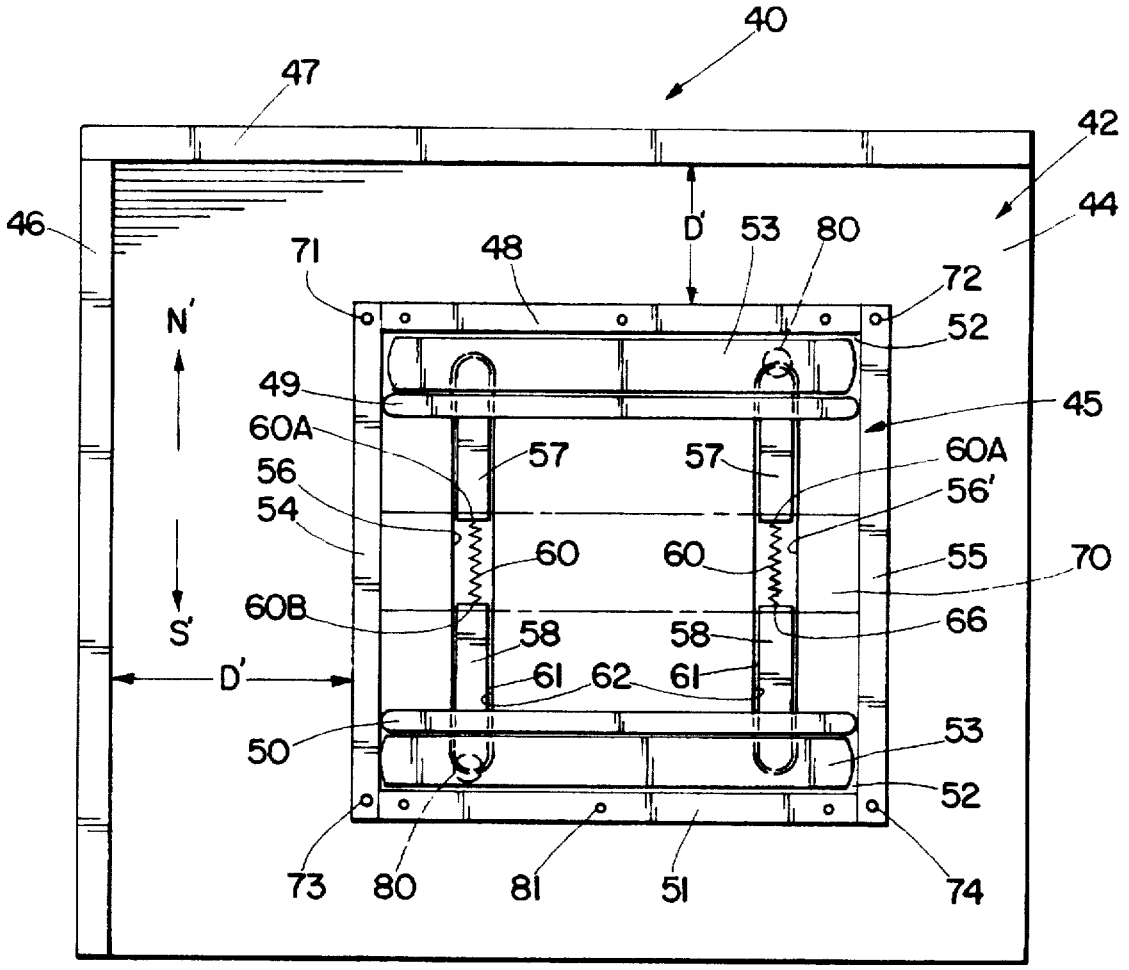
FIG. 2 is a top plan view of the apparatus of the present invention.

FIG. 2 shows the apparatus 40 of the present invention. In a preferred embodiment, the apparatus 40 generally incorporates a combination of reinforcement guides and spacers to assist in the assembly of a basket's bottom panel. These elements work in concert with alignment rims and locators to accurately align a basket's weaving splints during construction. Each combination is substantially similar with the exception of its relationship to the platform. The number of reinforcement guides and spacers is dependent on the size and shape of the desired basket bottom panel. It will be appreciated that minor changes to the guide/spacer configuration and its relationship to the platform may be made to facilitate construction of baskets having various sizes and shapes.

The apparatus 40 includes a platform 42 having a substantially horizontal upper planar surface 44. The apparatus 40 may be made from lightweight, durable materials, including wood, metal, plastic, or a combination of these. Wood is preferred for the apparatus platform 42 when making wooden baskets because the wooden weaving splints are less likely to slip on a wooden surface. Alignment rims 46 and 47 are located near the periphery of the platform 42 and extend transversely from the platform's upper surface 44. Grid-like markings (not shown in the drawing) may be provided on the upper surface 44 to aid in alignment of weaving splints.

Locators 71, 72, 73 and 74 extend transversely from the surface 44 of platform 42. The locators 71, 72, 73, 74 assist the former in determining the precise location of the four corners of the basket bottom panel, so the tops of the locators 71, 72, 73, 74 must extend above the weaving splints that will be arranged on the upper platform surface 44 of the platform 42 during bottom panel assembly. Locators that extend about ⅝-inch above the surface 44 are commonly used.

The apparatus 40 includes a guide mechanism 45 in communication with the platform 42. Fixed reinforcement guides 48 and 51 extend laterally along the upper surface 44 of the platform 42. A laterally extending inner edge guide 49, 50 is transversely spaced from an outer edge guide 48, 51. A movable edge guide 49, 50 is arranged parallel to and transversely separated from each fixed edge guide 48, 51. Each fixed edge guide 48, 51 and its associated moveable edge guide 49, 50 defines a space 52 therebetween capable of receiving a reinforcement splint having a width within a predetermined range and securely grasping splints 53 that vary somewhat in width, while allowing easy removal of the splints 53 from the apparatus 40 after they have been incorporated into a bottom panel. The number of edge guide pairs depends on the number of reinforcement splints desired, which may vary with the design and size of the basket bottom panel. Advantageously, each reinforcement guide 48, 49, 50 and 51 is at least as long as the reinforcement splint 53 to be aligned therewith. However, it is envisioned that smaller reinforcement guides may be employed that exert a sufficient grasping force on the reinforcement splints 53 to achieve satisfactory results.

Border members 54, 55 extend perpendicularly between the left and right ends, respectively, of the fixed and movable guides 48, 49, 50 and 51. The inner edges of the fixed guides 48, 51 and the border members 54, 55 are located within the rectangle defined by the locators 71, 72, 73 and 74 to assure that the reinforcement splints are located on the positioned on the woven center of the bottom panel that will form the basket bottom. The fixed guides 48, 51 and the border members 54, 55 may be integral to the platform 42 or may comprise one or more discrete components secured to the platform 42. The height of each reinforcement guide 48, 49, 50, 51 preferably is approximately equal to the thickness of the reinforcement splints 53 receivable within the spaces 52 so that the guides 48, 49, 50, 51 have a large enough edge surface to engage the reinforcement splints 53 while maintaining a substantially planar horizontal surface on the platform 42 for forming the bottom panel. The distance D' between the rim guides 46, 47 and the corresponding guide 48 or border member 54 defines the desired height of a basket's side panel. For a basket having a level top rim, the rim guide 46 may be substantially parallel to the fixed reinforcement guide 48. However, for a basket having a sloped top rim, the rim guide 46 may be angled relative to the reinforcement guide 48.

Cavities 56 and 56' are located within platform 42. The number of cavities and reinforcement guides used is dependent, in part, on the number and size of the reinforcements used. Each moveable guide is associated with at least one cavity, and at least one cavity is required for each pair of moveable reinforcements. Each cavity and its respective contents are substantially equivalent with the exception of its location within the platform and its positioning in relation to the reinforcement guides. Accordingly, the following description of cavity 56 applies equally to cavity 56' and to additional cavities if employed.

Cavity 56 houses spacers 57 and 58 and spring 60. The location of the spacers 57, 58 and spring 60 within the cavity 56 substantially isolates the mechanical operation of the apparatus 40 within the platform 42 to assist in maintaining a suitable work surface for bottom panel assembly. Spring 60 has an anterior end 60A attached to spacer 57 and a posterior end 60B attached to spacer 58, thereby providing a tensioned relationship between the spacers. The spacers 57, 58 each include a perimeter wall 61 that communicates with the inner wall 62 of the cavity 56. The spacers 57, 58 may be made from lightweight, durable, wear-resistant material that slides easily within cavity 56. Wood may be used, although a composite material such as "Linen Micarta" (a product of Westinghouse Electric Company) may yield superior results because of its strength, resistance to wear, dirt and debris, capacity for nonbinding movement, and amenability to lubrication with a dry lubricant such as graphite.

The combination of the spacers 57, 58, spring 60, and the pair of reinforcement guides 48, 49 provides a means for securing a reinforcement splint 53 during bottom panel assembly. Reinforcement guide 49 is fastened to spacer 57 such that displacement of the guide 49 causes movement of spacer 57 within cavity 56. In an inactive position, the spring 60 tends to force the spacers 57, 58 against the anterior and posterior ends of the cavity 56, which in turn tends to force the moveable guide 49 toward fixed guide 48. Thus, when a reinforcement splint 53 is received within the space 52, the moveable guide 49 urges the splint toward the fixed guide 48, and the tension exerted against the splint 53 by guides 48, 49 retains the reinforcement splint 53 in position during bottom panel assembly. If desired, the moveable guide 49 may be moved transversely away from the fixed guide 48, with a corresponding displacement of spacer 57 toward spacer 58, to assist in inserting the splint 53 in the space 52. Guides 50 and 51 operate in a like manner.

Each spacer 57, 58 within a cavity 56 may be attached to a moveable reinforcement guide 49, 50 such that a single spring 60 provides tension on the two moveable reinforcement guides 49, 50. However, the present invention also contemplates provision of a cavity, a spring, and a spacer for each moveable reinforcement guide, with the spring extending between the spacer and an end wall of the cavity rather than between opposing spacers within the cavity.

A plate 65 (best shown in FIG. 3) may be positioned in space 52 adjacent to a fixed reinforcement guides 48, 51 and fastened to platform 42. The plate 65 extends transversely above the surface 44 a distance sufficient to limit the transverse movement of reinforcement guide 49 toward fixed guide 48. This limiting feature prevents abutment of guides 48 and 49 when no splint 53 is present within the space 52 but allows the edges of the guides 48, 49 to engage a splint 53 received in space 52. The plate 65 also may provide a suitable base for tacking basket components to one another, if desired. The plate 65 may be formed from a strong, puncture-resistant material, preferably metal. Preferably, the plate 65 is secured to the platform 42 with screws or other metal fasteners and the plate 65 and the heads of the fasteners are treated, for example, by brazing and grinding, to form a smooth surface. This smooth surface helps to avoid bent tacks that may result if the tacks strike a fastener head or other irregularity in the surface of the plate 65.

A center bar 70, shown in phantom on FIG. 2, may be removably attached to the platform 42 between the moveable guides 49, 50. The laterally extending center bar 70 limits the transverse movement of reinforcement guides 49 and 50 away from fixed guides 48 and 51, respectively. The center bar 70 also provides a cover for the moving parts of the apparatus 40, and is easily removed to gain access to the moving parts should repair or replacement of these parts be required.

Figure 3:
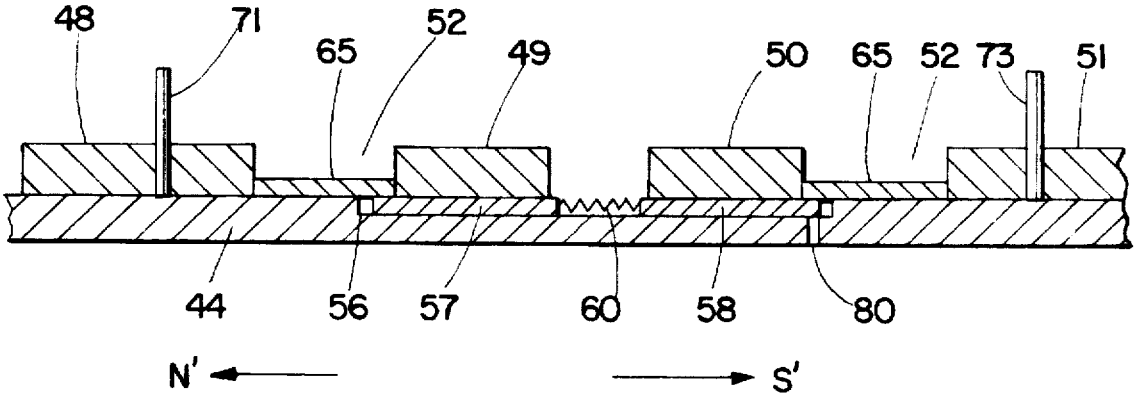
FIG. 3 is a cross-sectional side view of the apparatus of FIG. 2 illustrating the position of a spacer within the platform and its relationship to each of the reinforcement guides.

FIG. 3 is a partial sectional side view of the guide apparatus 40. As a reinforcement splint 53 is placed in space 52, guide 49 is retracted in direction S' which draws spacer 57 toward spacer 58, thereby compressing spring 60. The spring 60 in its compressed position imparts an opposite force against spacer 57 and in turn against guide 49 in direction N'. Therefore, the force in direction N' by movable guide 49 and the equal and opposite force in direction S' by stationary guide 48 exerted on the reinforcement splint 53 located in space 52, cooperate to secure the splint 53 in position during bottom panel assembly.

Similarly, as a splint 53 is placed in space 52, guide 50 (which is fastened to spacer 58) retracts, thereby compressing spring 60 and imparting transverse force against spacer 57 in direction N'. As may be inferred from the above description, when guides 49 and 50 are retracted simultaneously, spacers 57 and 58 move toward one another, causing spring 60 to compress and imparting forces against the spacers in directions N' and S', respectively. Because guides 49 and 50 are connected to spacers 57 and 58, the guides 49, 50 exert forces on the reinforcement splints 53 located in spaces 52 in directions N' and S' respectively, thereby securing the splints 53 in position.

During use of the apparatus 40, splinters, sawdust and similar debris from the weaving process may accumulate within the cavity 56, and particularly at the outer ends of the cavity 56 under bar 65. This debris tends to keep guides 49, 50 from retracting to a fully open, splint-receiving position. The apparatus 40 therefore may include a duct 80 located within the platform 42 and communicating with cavity 56 to facilitate removal of the accumulated debris.

The fixed guides 48, 51 and border members 54, 55 may be mounted to the surface 44 of the platform 42, for example, by screws or other fasteners 81, for ease of production of the apparatus 40. However, it also is possible to recess these components below the surface 44 of the platform 42, such that their upper surfaces are flush with the platform surface 44. Even when the fixed guides 48, 51 and border members 54, 55 are recessed within the platform 42, however, the tops of the locators 71, 72, 73 and 74 continue to extend transversely above the platform surface. If desired, a existing guide platform 12 (see FIG. 1) may be modified to incorporate the mechanism 45 of the present invention by providing cavities in the existing platform 12 and substituting the mechanism 45 of the present invention (with its associated moveable edge guides 48, 49, 50, 51, spacers 57, 58 and springs 60) for the existing frame 25.

The guide apparatus 40 of the present invention may be used as described below with reference to both FIGS. 2 and 3. This description assumes that two reinforcement splints 52 will be used in bottom panel construction; however, satisfactory results also may be obtained using different numbers of reinforcements. By way of example, the reinforcement splints may have a thickness of approximately 1/16" when used in general purpose hand-woven wooden baskets having dimensions in the range of 15×10×7 ½ inches; however, satisfactory results may be achieved using reinforcement splints with different thicknesses.

First and second reinforcement splints precut to a desired thickness and a length at least slightly smaller than the corresponding dimension of the basket bottom are placed in the spaces 52. The associated moveable guides 49, 50 are retracted as the reinforcement splints 53 are placed in the spaces 52, respectively, causing spacers 57 and 58 to move transversely toward one another within cavity 56. Similar spacer movement occurs within cavity 56' in response to retraction of the guides 49, 50.

Figure 4A:
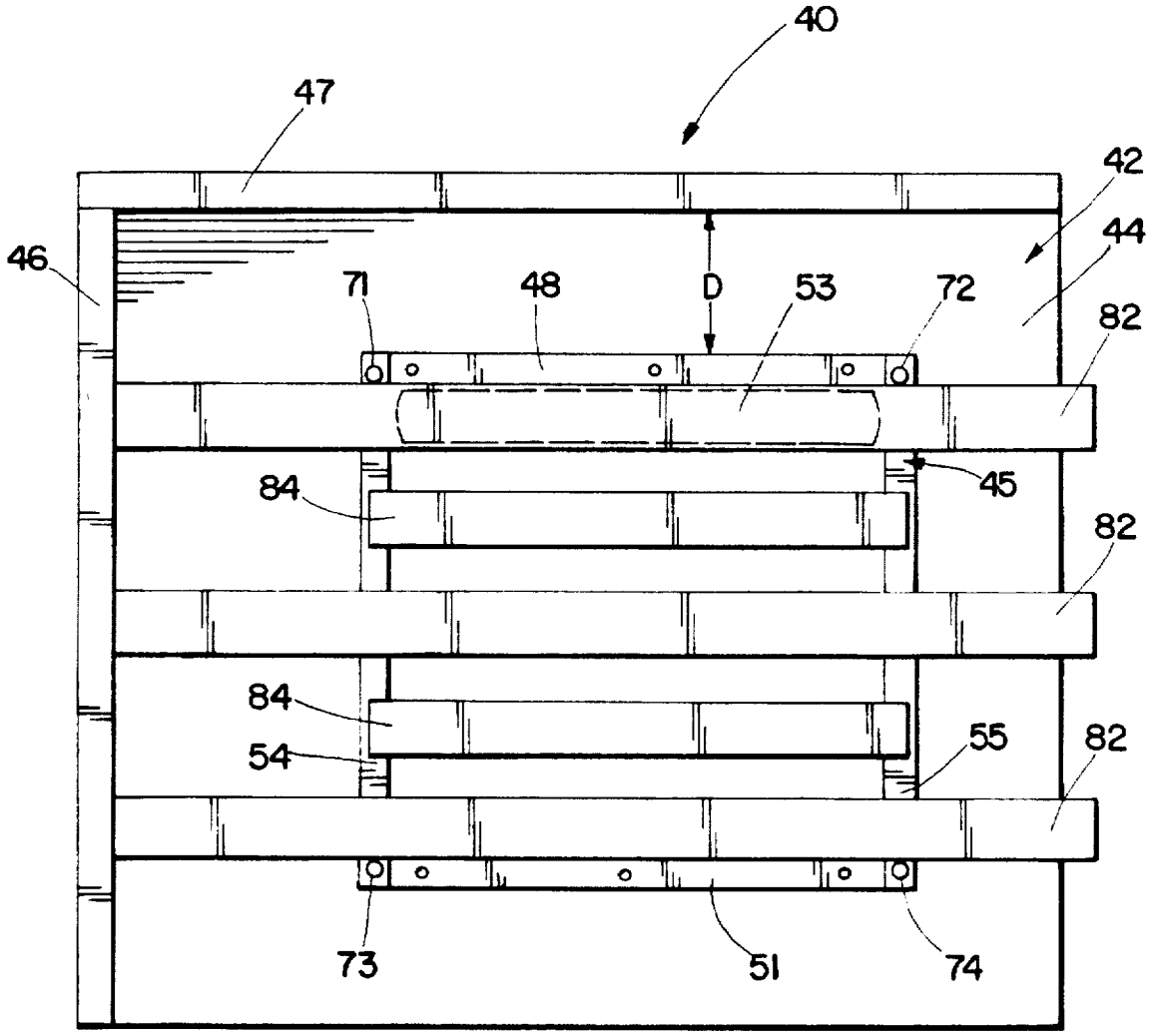
FIG. 4A is a top plan view of the guide of FIG. 2 illustrating the arrangement of cross splints and fill splints on the guide.

Cross splints 82 are placed on the platform 42 in a generally parallel relationship to the reinforcement splints 53 secured in the spaces 52 and with one another, and in a generally perpendicular relationship to cavities 56, 56', as shown in FIG. 4A. A lateral end of each dross splint abuts rim 46. The side of the top outer cross splint 82 is positioned inside of and adjacent to locators 71 and 72, and the side of the bottom outer cross splint 82 is positioned inside of and adjacent to locators 73 and 74. Generally, the cross splints 82 are transversely spaced a distance from one another. Fill splints 84 may be interposed between the cross splints 82, if desired, to aid in spacing of the cross splints 82 and provide a more solid basket bottom.

Figure 4B:
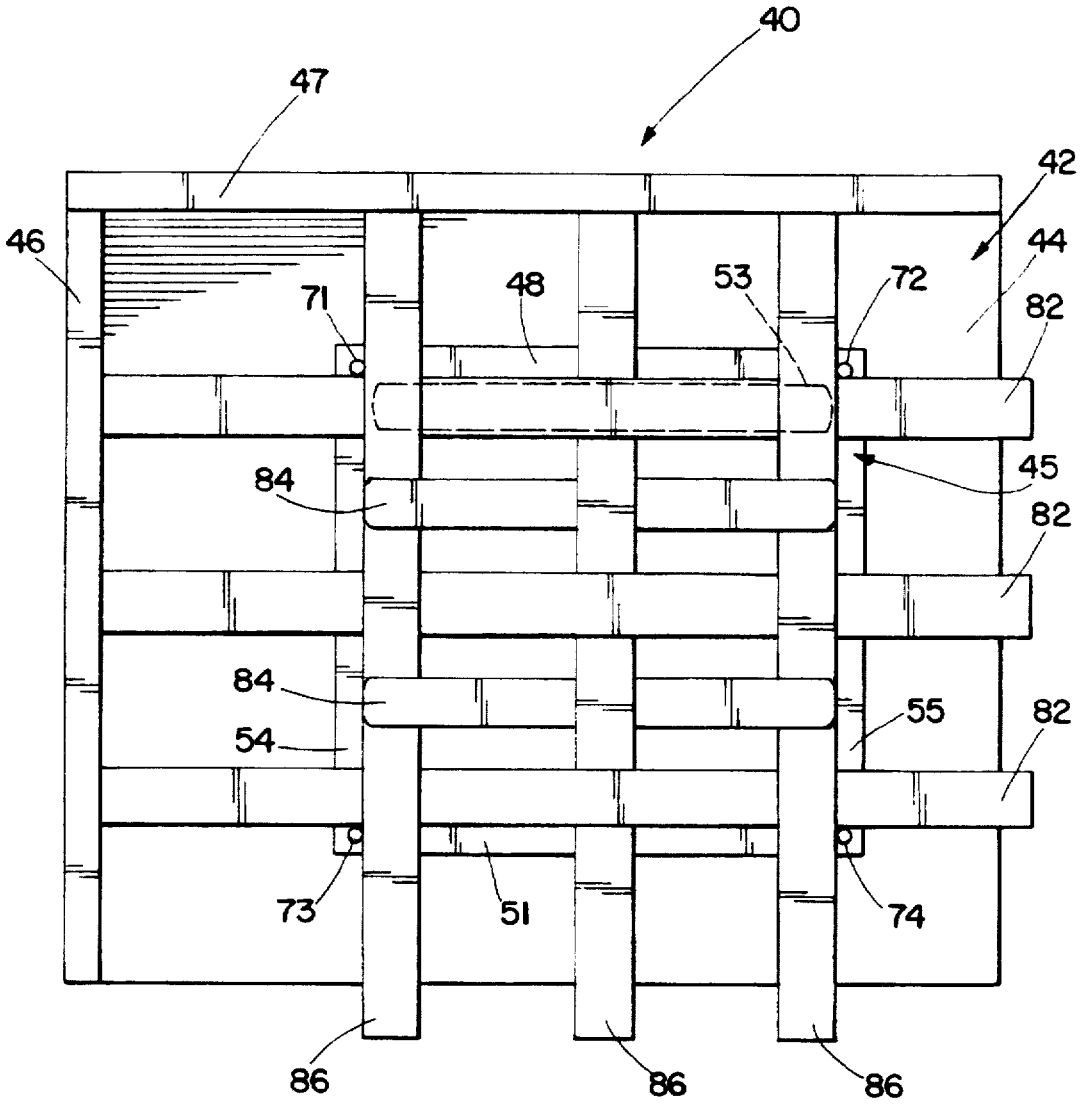
FIG. 4B is a top plan view of the guide of FIG. 4A illustrating the arrangement of up splints on the guide and the relationship of the up splints to the cross splints and fill splints.

Up splints 86 are arranged perpendicularly to the reinforcements and the cross splints 82, and in generally parallel relationship with the cavities 56, 56' and with one another, as shown in FIG. 4B. An end of each up splint 86 abuts rim 47. The side of the left outer up splint 86 is positioned inside of and adjacent to locators 71 and 73, and the side of the right outer up splint 86 is positioned inside of and adjacent to locators 72 and 74. As with the cross splints 82, the up splints 86 generally are transversely spaced a distance from one another.

The rims 46 and 47 assist in locating the woven center relative to the unwoven splint ends that will comprise the side panels, and in establishing the desired alignment of the weaving splints during basket construction. Grid markings provided on the platform surface 42, not shown in the drawings, also may be used to maintain the alignment of the splints and to assist in spacing the splints at a desired distance from one another.

The up splints 86 are woven through the cross splints 82. An alternating, over-and-under weave pattern is commonly used, although other weave patterns also may be used with satisfactory results. To assist in maintaining the position of the cross splints 82 during weaving, a weighted block, not shown in the drawings, may be placed on the cross splints 82 between the rim 26 and the border member 54. The weaving continues until the area defined by the four locators 71, 72, 73, and 74 is filled by weaving.

Figure 4C:
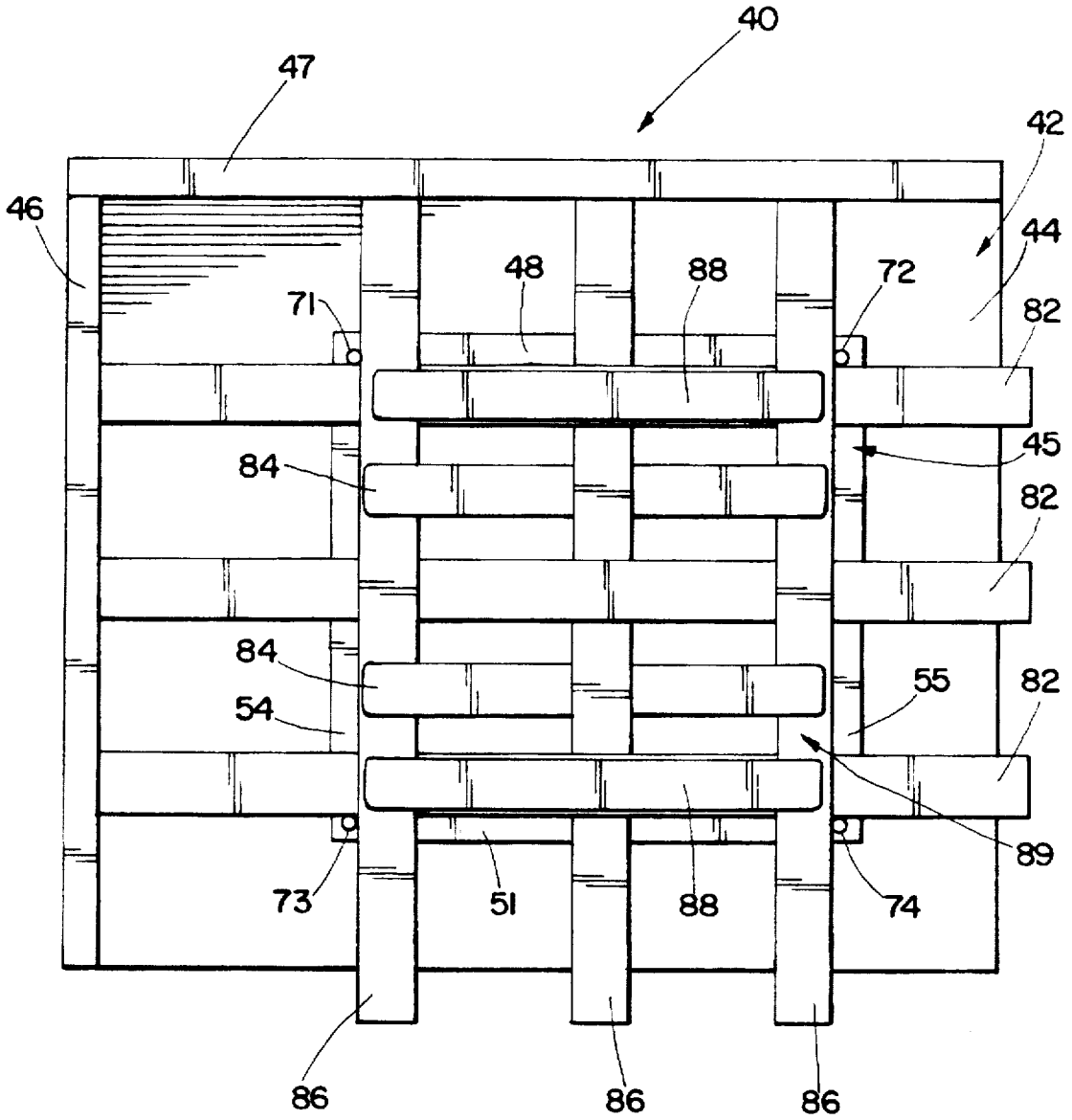
FIG. 4C is a top plan view of the guide of FIG. 4B illustrating the arrangement of outer reinforcement splints on the woven center.

Outer reinforcements 88 may be positioned on the woven center in substantially overlaying relationship to the inner reinforcements 53, as shown in FIG. 4C. This may be accomplished by reference to the locators 71, 72, 73, 74 (for reinforcements located near an edge of the basket bottom panel), and by manual pressure on the formed bottom panel 89 to ascertain the areas of the bottom panel 89 with less give, indicating the presence of an underlying inner reinforcement splint 53. Experienced formers readily can locate the inner splints using these methods.

The weaving splints may then be secured to one another and to the reinforcement splints. Preferably, the weaving splints and reinforcements are secured together by fasteners such as tacks, although other suitable methods of securing these bottom panel components also may be used. After the weaving splints and the reinforcements have been secured together, the panel may be lifted from platform 42. The lifting action is sufficient to overcome the force exerted on the reinforcements 53 by the guides 48, 49, 50 51, allowing removal of the reinforcements 53 from the spaces 52. After the bottom panel has been formed, it may be used to produce a finished basket as described above.

Figure 5:
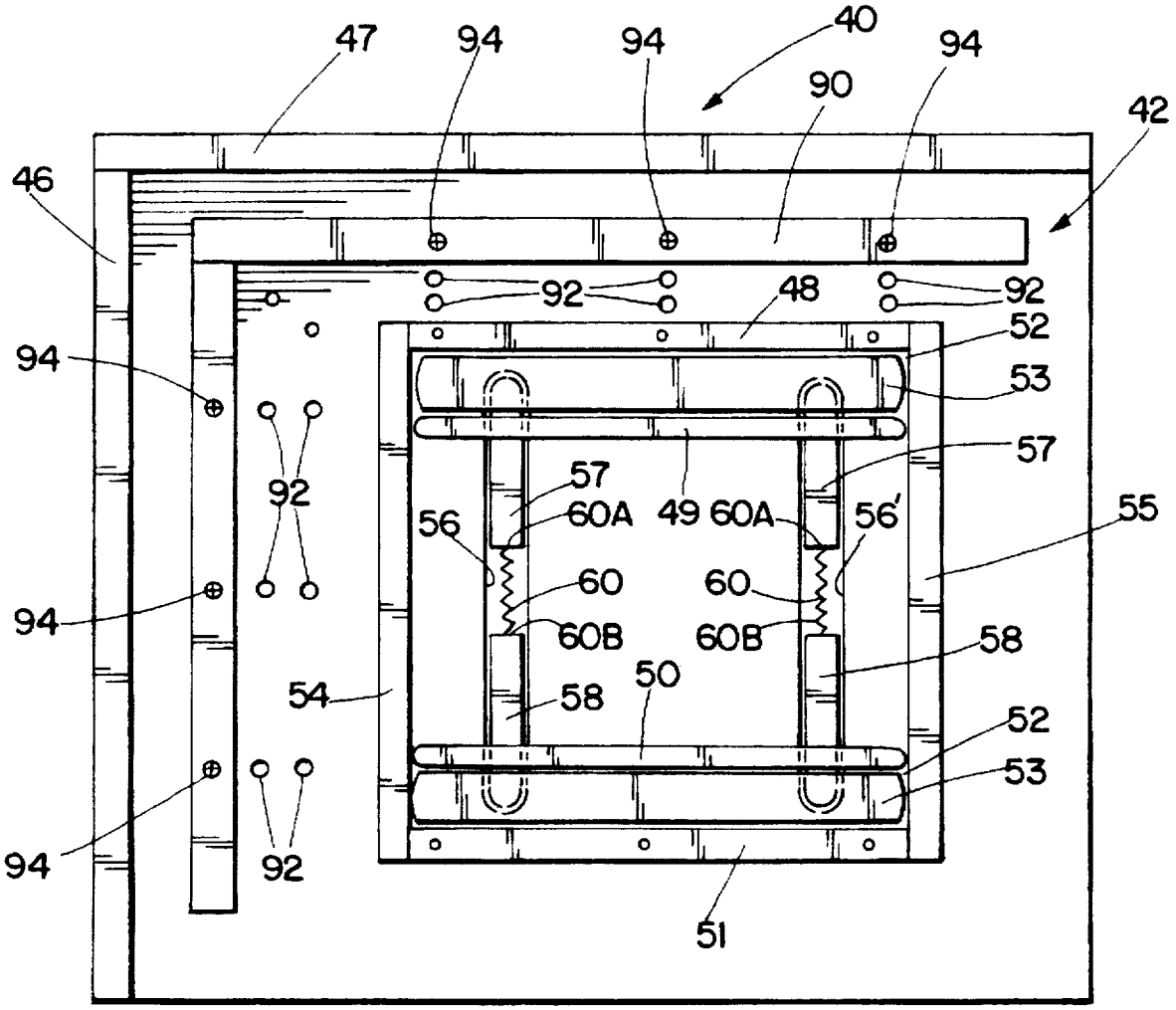
FIG. 5 is a top plan view of another embodiment of the apparatus of the present invention illustrating an adjustable rim guide.

In another embodiment of the present invention, the platform 42 may be provided with an adjustable rim member 90, in addition to or instead of the fixed rims 46, 47. The adjustable rim 90 permits use of the apparatus 40 to make baskets having the same sized bottom panels but differently sized side panels. As shown in FIG. 5, the platform 42 may be provided with a plurality of bores 92 arranged in a pattern corresponding to a desired rim location. If desired, the bores 92 may be arranged in a plurality of such patterns, with each pattern spaced a different distance from the frame 45.

A removable rim member 90 may be provided including bores 94 arranged in a pattern corresponding to the pattern on the platform 42. The adjustable rim 90 may be positioned on the platform 42 so that the bores 94 of the rim 90 are aligned with the bores 92 in a desired bore pattern on the platform 42. The adjustable rim member 90 may be secured to the platform 42 by pins or other suitable fasteners inserted through the bores 94 and into the bores 92. The adjustable rim 90 may be a single angled member, such as the L-shaped member shown in FIG. 5, or a pair of elongated members, not shown in the drawings.

Thus, the present invention provides an apparatus for assisting in the construction of hand-woven baskets which results in uniformly shaped baskets. The present invention facilitates faster bottom panel assembly than with known guides and provides a means for accurately and quickly aligning weaving splints during bottom panel assembly.

Although a specific embodiment of the invention has been described herein in detail, it is understood that variations may be made thereto by those skilled in the art without departing from the spirit of the invention or the scope of the appended claims.

What is claimed is:

1. An apparatus for use in forming basket bottom panels, said apparatus comprising:

a platform having an upper planar surface, a ridge projecting above said surface and a cavity recessed below said surface, said cavity defining an inner wall;

a spacer housed within said cavity, said spacer having a perimeter wall in communication with said inner wall of said cavity;

a spring fastened to said spacer, said spring facilitating tensioned movement of said spacer within said cavity; and a reinforcement guide separated transversely from said ridge and communicating with said upper planar surface, said ridge and said reinforcement guide forming a space therebetween capable of removably receiving a reinforcement splint, said guide attached to said spacer, said spring urging said spacer and its associated guide toward said ridge to retain a reinforcement within said space.

2. The apparatus of claim 1, wherein said cavity is positioned in a substantially perpendicular relationship with said reinforcement guide and said ridge.

3. The apparatus of claim 1, further including a locator extending transversely from said upper platform surface, said locator positioned to assisting in alignment of a weaving splint.

4. The apparatus of claim 1, further including an alignment rim connected to said platform at a predetermined distance from said first reinforcement guide, said alignment rim receiving a first end of a weaving splint in an abutting manner.

5. A spring-actuated basket form comprising:

a platform having an upper planar surface and a cavity recessed within said surface, said cavity having an inner wall;

first and second spacers located within said cavity, each of said first and second spacers having a perimeter wall movably communicating with said inner wall of said cavity;

a spring having anterior and posterior ends, said anterior end coupled with said first spacer, said posterior end coupled with said second spacer, said spring facilitating tensioned movement of said first and second spacers within said cavity; and first and second longitudinally extending and transversely separated reinforcement guides, said guides communicating with said upper surface of said platform, said first guide connected to said first spacer and capable of retraction with respect to said second guide, said first and second guides forming a space therebetween capable of releasably receiving a reinforcement splint.

6. The apparatus of claim 5, wherein said first and second reinforcement guides are positioned in a substantially perpendicular relationship with said cavity.

7. The apparatus of claim 5, further including a locator, said locator extending transversely from said upper platform surface, said locator positioned to assist in alignment of a weaving splint.

8. The apparatus of claim 5, further including an alignment rim in communication with said platform at a predetermined distance from said second reinforcement guide, said alignment rim receiving a first end of a weaving splint in an abutting manner.

9. The apparatus of claim 5, wherein said platform further includes a second cavity recessed below said surface, said second cavity having an inner wall.

10. The apparatus of claim 9, further including third and fourth spacers located within said second cavity, each of said third and fourth spacers having a perimeter wall movably communicating with said inner wall of said second cavity.

11. The apparatus of claim 10, further including a second spring having anterior and posterior ends, said anterior end of said second spring coupled with said third spacer, said posterior end of said second spring coupled with said fourth spacer, said second spring facilitating tensioned movement of said third and fourth spacers within said second cavity.

12. The apparatus of claim 11, further including third and fourth longitudinally extending and transversely separated reinforcement guides, said third and fourth guides communicating with said upper surface of said platform, said third guide connected to said third spacer and capable of retraction with respect to said fourth guide, said third and fourth guides forming a space therebetween capable of releasably receiving a second reinforcement splint.

13. The apparatus of claim 5, further including an alignment rim in communication with said platform and positioned an adjustable distance from said second reinforcement guide, said alignment rim receiving a first end of a weaving splint in an abutting manner.

14. A spring-actuated basket form comprising:

a platform having an upper planar surface and defining first and second cavities recessed below said surface, each of said cavities having an inner wall;

first and second spacers located within said first cavity, each of said spacers having a perimeter wall movably communicating with said inner wall of said first cavity;

a first spring having anterior and posterior ends, said anterior end coupled with said first spacer, said posterior end coupled with said second spacer, said spring facilitating tensioned movement of said first and second spacers within said first cavity;

first and second longitudinally extending and transversely separated reinforcement guides communicating with said upper surface of said platform, said first guide connected to said first spacer and capable of retraction with respect to said second guide, said first and second guides forming a space therebetween capable of removably receiving a reinforcement splint;

a locator extending transversely from said upper platform surface, said locator capable of assisting in alignment of a weaving splint;

third and fourth spacers located within said second cavity, each of said third and fourth spacers movably communicating with said inner wall of said second cavity;

a second spring having anterior and posterior ends, said anterior end coupled with said third spacer, said posterior end coupled with said fourth spacer, said second spring facilitating tensioned movement of said third and fourth spacers within said second cavity;

third and fourth longitudinally extending and transversely separated reinforcement guides, said guides communicating with said upper surface of said platform, said third guide connected to said third spacer and capable of retraction with respect to said fourth guide, said third and fourth guides forming a space therebetween capable of releasably receiving a second reinforcement splint; and an alignment rim in communication with said platform at a distance from said first reinforcement guide.

15. A method for assisting in the construction of hand-woven baskets using a spring-actuated basket form, comprising the steps of:

placing a reinforcement splint between first and second transversely separated and longitudinally extending reinforcement guides, said guides communicating with an upper surface of a platform;

abutting a weaving splint against an alignment rim, said alignment rim extending transversely from said upper platform surface and positioned a predetermined distance from said first reinforcement guide;

weaving a plurality of splints in a predetermined arrangement with respect to said reinforcement splint;

securing the plurality of woven splints to the reinforcement splint;

retracting said first reinforcement guide transversely away from said second reinforcement guide; and removing the reinforcement splint and its associated woven splints from engagement with said first and second reinforcement guides.

16. The method of claim 15, further comprising the step of abutting the side edge of a weaving strip against a locator extending transversely above said surface.

17. A method for constructing a hand-woven basket utilizing a spring-actuated basket form, comprising the steps of:

placing a first reinforcement splint between first and second reinforcement guides, said first guide separated transversely and extending longitudinally with respect to said second guide, said guides communicating with an upper surface of a platform;

placing a second reinforcement splint aligned with said first reinforcement splint in a second space defined by a third and fourth reinforcement guides, said third reinforcement guide separated transversely and extending longitudinally with respect to said fourth reinforcement guide, said third and fourth guides communicating with the upper surface of the platform and located a specified distance from said first and second reinforcement guides;

abutting a weaving splint against an alignment rim in communication with said platform;

weaving a plurality of splints in a predetermined arrangement with respect to said first and second reinforcement splints;

securing the first and second reinforcement splints to the plurality of woven splints;

retracting the first reinforcement guide transversely away from said second reinforcement guide; and removing the first and second reinforcement splints and the associated plurality of woven splints from engagement with first and second and the third and fourth reinforcement guides.

18. A method for aligning basket splint members utilizing a spring-actuated basket form, comprising the steps of:

retracting a reinforcement guide located on a platform;

placing a first reinforcement splint in a space defined by said reinforcement guide and a second reinforcement guide, said second reinforcement guide separated transversely and extending longitudinally with respect to said first reinforcement guide, said first and second reinforcement guides communicating with an upper surface of said platform;

retracting a third reinforcement guide located on said platform;

placing a second reinforcement splint in a second space defined by said third reinforcement guide and an fourth reinforcement guide, said fourth reinforcement guide separated transversely and extending longitudinally with respect to said third reinforcement guide, said third and fourth reinforcement guides communicating with said upper platform surface and located at a distance from said first and second reinforcement guides;

abutting a weaving splint against an alignment rim located an adjustable distance from said first reinforcement guide;

weaving a plurality of splints in a predetermined arrangement with respect to said first and second reinforcement splints;

securing the first and second reinforcement splints to the plurality of weaving splints; and removing the first and second reinforcement splints and the associated plurality of weaving splints from placement in said first and second spaces.

19. The method of claim 18, further comprising the steps of:

arranging first and second outer reinforcements on the plurality of weaving splints in substantially overlaying relationship to the first and second reinforcement splints;

securing said first and second outer reinforcements to said first and second reinforcement splints and said plurality of weaving splints.

20. The method of claim 18, wherein said step of arranging said first and second outer reinforcements on said plurality of weaving splints in substantially overlaying relationship to the first and second reinforcement splints is performed by aligning said outer reinforcements by reference to locators extending transversely from said upper platform surface.

21. An apparatus for use in securing a reinforcement splint during forming of a basket bottom panel, said apparatus comprising:

a platform having a upper surface and a ridge extending transversely above said platform surface;

a slidably moveable splint-engaging guide in communication with said upper platform surface, said guide transversely spaced from said ridge, said ridge, said platform surface and said guide defining a splint-receiving slot, a bottom reinforcement splint being removably receivable

22. The apparatus of claim 21 wherein said guide is biased to urge a splint received within said slot toward said ridge.

23. The apparatus of claim 22, wherein said platform further includes a cavity oriented transversely to said slot, said cavity having an inner wall;

a spacer housed within said cavity, said spacer having a perimeter wall in communication with said inner wall of said cavity, said spacer being biased to facilitate tensioned movement of said spacer within said cavity and cause said moveable guide to urge a splint received within said slot toward said ridge.

24. The apparatus of claim 21, further including an alignment rim in communication with said upper platform surface.

25. The apparatus of claim 24, wherein said alignment rim is adjustably movable on said platform surface relative to said ridge.

* * * * *